US011085235B2

(12) United States Patent
McCreadie

(10) Patent No.: US 11,085,235 B2
(45) Date of Patent: Aug. 10, 2021

(54) APPARATUS AND METHODS FOR USE WITH BLINDS AND LOUVRES

(71) Applicant: Decor Systems Limited, Doncaster (GB)

(72) Inventor: Richard McCreadie, Doncaster (GB)

(73) Assignee: DECOR SYSTEMS LIMITED, Doncaster (GB)

( * ) Notice: Subject to any disclaimer, the term of this patent is extended or adjusted under 35 U.S.C. 154(b) by 380 days.

(21) Appl. No.: 15/772,375

(22) PCT Filed: Oct. 25, 2016

(86) PCT No.: PCT/GB2016/053316

§ 371 (c)(1),
(2) Date: Apr. 30, 2018

(87) PCT Pub. No.: WO2017/072497

PCT Pub. Date: May 4, 2017

(65) Prior Publication Data

US 2018/0320439 A1 Nov. 8, 2018

(30) Foreign Application Priority Data

Oct. 30, 2015 (GB) ..... 1519176

(51) Int. Cl.

| | |
|---|---|
| ***E06B 9/324*** | (2006.01) |
| ***E06B 9/326*** | (2006.01) |
| ***E06B 9/68*** | (2006.01) |
| ***E06B 9/78*** | (2006.01) |

(Continued)

(52) U.S. Cl.

CPC ..... *E06B 9/324* (2013.01); *E06B 9/326* (2013.01); *E06B 9/50* (2013.01); *E06B 9/68* (2013.01);

(Continued)

(58) Field of Classification Search

CPC . E06B 9/324; E06B 9/326; E06B 9/78; E06B 9/90; E06B 2009/6881; E06B 2009/785

See application file for complete search history.

(56) References Cited

U.S. PATENT DOCUMENTS 1,541,261 A * 6/1925 Harris ..... E06B 9/64 160/258
2,029,675 A * 2/1936 Schlamp ..... E06B 9/78 160/121.1

(Continued)

FOREIGN PATENT DOCUMENTS

| | | |
|---|---|---|
| DE | 296 12 024 U1 | 9/1996 |
| EP | 1 672 164 A2 | 6/2006 |
| GB | 2 480 286 A | 11/2011 |

OTHER PUBLICATIONS

International Search Report of International Application PCT/GB2016/053316 dated Mar. 14, 2017.

*Primary Examiner* — Daniel P Cahn
*Assistant Examiner* — Abe Massad
(74) *Attorney, Agent, or Firm* — Woodard, Emhardt, Henry, Reeves & Wagner, LLP

(57) ABSTRACT

The invention to which this application relates is apparatus and a method for use with blinds and louvres, hereinafter referred to, in a non-limiting manner, as blinds and which includes roller blinds, roman blinds and Venetian blinds. The apparatus and method allows the free end of the blind to be selectively positioned and retained at a predetermined position intermediate the fully retracted and fully extended positions and to be retained at that position.

16 Claims, 14 Drawing Sheets

(51) Int. Cl.
*E06B 9/90* (2006.01)
*E06B 9/50* (2006.01)

(52) U.S. Cl.
CPC ..... *E06B 9/78* (2013.01); *E06B 9/90* (2013.01); *E06B 2009/6845* (2013.01); *E06B 2009/6881* (2013.01); *E06B 2009/785* (2013.01)

(56) References Cited

U.S. PATENT DOCUMENTS 2,577,046 A * 12/1951 Svirsky ..... E06B 9/78 160/321
4,424,852 A * 1/1984 Hopper ..... E06B 9/78 160/309
4,475,580 A * 10/1984 Hennequin ..... E06B 9/78 160/308
5,906,233 A * 5/1999 May ..... E06B 9/326 160/178.1 R
6,250,359 B1 * 6/2001 Lorio ..... E06B 9/326 160/178.1 V
7,353,857 B2 * 4/2008 Koop ..... E06B 9/324 160/178.1 R
8,763,675 B2 * 7/2014 Zhu ..... E06B 9/324 160/321
9,212,518 B2 * 12/2015 Mann ..... E06B 9/324
10,337,243 B2 * 7/2019 Berman ..... E06B 9/326
2006/0243402 A1 * 11/2006 Chang ..... E06B 9/40 160/321
2016/0053537 A1 * 2/2016 Dybdahl ..... E06B 9/50 160/310

* cited by examiner

APPARATUS AND METHODS FOR USE WITH BLINDS AND LOUVRES

The invention to which this application relates is apparatus and a method for use with blinds and louvres, hereafter referred to, in a non-limiting manner, as blinds and which includes roller blinds, roman blinds and venetian blinds.

Blinds are typically provided for use with windows and can normally be moved between a fully raised position when no shading is required, and a fully extended position when full shading is required, and at locations intermediate the same to provide partial shading. Each blind will typically be provided to cover one or more windows. However, when the blinds are used for relatively large scale buildings, such as office blocks, a number of blinds will be provided side by side so as to, in combination, provide the ability to provide shading along a length of the number of windows.

In one embodiment, the adjustment of the height of the blind with respect to the window is adjusted by moving an adjustment mechanism. The mechanism comprises a drive wheel which is connected to a roller about which the blind is rolled, such that movement of the drive wheel in a first direction moves the free end of the blind up and, in the opposing direction, moves the free end of the blind down. The drive wheel is, in one embodiment connected to a drive member which is provided as a continuous loop and there are provided, at equispaced intervals along the drive member, balls or other protrusions which engage with recesses provided around the wheel so as to allow the movement of the drive member to be imparted to the drive wheel and, in turn, to drive the blind movement. The spacing of the recesses around the drive wheel is the same as that of the spacing between the balls such that one ball is received in each consecutive recess. The drive wheel is also provided with a surrounding cage which acts to retain each ball in the respective recess and thereby ensure continued engagement between the drive member and the drive wheel.

While this provides the ability for each blind to be independently operated, it does mean that in practice each, or many, of the blinds are commonly adjusted to different heights along the length of the combination of blinds. This can mean that the appearance of the blinds is unsightly, both internally of the building and externally of the same and there is a need to be able to overcome this problem, without adding complexity to the operation of the blind.

It is known to provide a blind system in which the location of the blind can be stopped to define a fully lowered position or a fully raised position of the blind, rather than a specific stop position at an intermediate location. For example, in EP1672164 there is disclosed the provision of a "stopper" which can be attached between adjacent balls on the drive ball chain to aid in the stopping of the blind at a particular location but this therefore requires that the stopper is fitted at the correct location on each blind and also that the stoppers, which are detachable, are not lost or become detached. In GB2480286, there is disclosed an alternative system in which an enlarged ball is located on the ball chain at the required location of the stop of the blind, but this creates difficulties in being able to accommodate the smooth movement of the enlarged ball through the drive mechanism for the blind.

An aim of the present invention is therefore to provide a blind with a drive mechanism which includes the ability to allow the height of the free end of the blind to be located at a predetermined position with respect to the window with which the same is fitted and to allow the same to be achieved whilst maintaining the ease of operation of the blind. A further aim is to provide the drive mechanism with a number of blinds such that the same predetermined position can be uniformly achieved by each of the blinds.

In a first aspect of the invention there is provided apparatus which includes at least one portion of sheet material which forms a blind, a drive mechanism for determining and adjusting the extent to which a free end of the blind extends from a roller of the drive mechanism and wherein the apparatus further includes an engagement system which, when engaged, acts to prevent rotation of the drive mechanism and hence retain the blind at at least one predetermined position intermediate the fully extended and retracted positions of the blind.

When in the retracted position the sheet material is fully wound around the roller of the drive mechanism.

In one embodiment the engagement system includes an engaging member which engages with a portion of the drive member which is operated by the user to adjust the position of the blind.

In one embodiment the drive member includes a formation portion at at least one location therealong, said portion provided to be engagable with the engaging member to define the said predetermined position of the sheet material.

In one embodiment the blind drive mechanism is biased towards a default position.

In one embodiment the blind drive mechanism moves to the default position unless the movement is prevented by engagement of the formation portion with the engaging member.

In one embodiment the engagement occurs automatically as the formation portion reaches the engaging member. Alternatively, the engagement occurs when the user selectively positions the drive member with respect to the engaging member so as to cause engagement of the formation portion with the engaging member as it reaches the engaging member.

In one embodiment the drive mechanism incorporates a counterbalance drive mechanism.

In one embodiment the predetermined position is selected by selectively locating the engaging member at a fixed position and/or the location of the formation portion on the drive member of the drive mechanism.

In one embodiment the engaging member is located on the blind apparatus or alternatively on the structure to which the blind apparatus is attached, such as on the frame of the window for which the apparatus is provided for use and/or on a wall adjacent to the said window.

In one embodiment the said formation portion is a gap between adjacent protrusions on the elongate member which is greater than the gap between adjacent protrusions along at least the majority of the drive member.

Typically the elongate drive member includes a series of protruding portions provided on a cord at substantially equally spaced intervals therealong and the formation portion is provided as a length of said cord which has a length which is greater than the spacing between said protruding portions.

In one embodiment the ends of the said formation portion is defined by respective protruding portions located on said cord and which are spaced apart by a distance which is greater than the spacing between the said protruding portion and the respective protruding portion located on the opposing side of the cord from the drive formation.

In one embodiment the drive member passes through an aperture formed in the engaging member, said aperture having a longitudinal axis, and said drive member moves through the aperture along an axis which is substantially perpendicular to the longitudinal axis of said aperture In one embodiment the aperture has first and second portions located along the longitudinal axis, said first portion of a dimension to allow the protruding portions of the drive member to pass therethrough and the second portion of a size to prevent the movement of the drive member protruding portions therethrough.

Typically the drive member is selectively movable along said longitudinal axis of the aperture to cause the drive member to be moved between free and engaged positions with the engaging member.

In one embodiment the engaging member and drive member are respectively positioned and/or provided so as to bias the drive member towards the second portion of the aperture so that the formation portion on the drive member locates therein when located at the engaging member.

In one embodiment when the said formation portion is at the location of the engaging member the user presses the formation into the engaging member to thereby retain the drive member and the blind at the predetermined position.

Alternatively, when the formation portion is at the location of the engaging member, retention means provided on the member engage the formation portion and retain the drive member and hence blind material at the predetermined position.

In one embodiment the engagement member includes a component which is biased towards a position in which the same will lock the drive member in position when the formation portion is located therewith and hence lock the blind at the predetermined position. Typically, in this position a reset button is provided.

In another embodiment the engagement member is provided in the form of an optoelectronic device which detects the presence of the formation portion of the drive member and stops movement of the drive member so as to retain the blind in the desired position.

In one embodiment the formation portion of the drive member includes a magnet or magnetically attractive material therein so as to allow the presence of the same to be magnetically attractive to a magnet or magnetically attractive material therein and hence allow the drive member to be retained at that location.

In another embodiment a stop system is provided with the drive mechanism which is provided to allow the detection of the predetermined position and retention of the blind at that predetermined position until steps are taken to release the stop of the drive mechanism.

In one embodiment a plurality of blinds are provided along a length and an engaging member is provided for each of the blinds, said engaging members provided at the same height such that when the formation of the drive member for each respective blind is retained thereby, the sheet material of each of the blinds is provided at the same uniform position.

In one embodiment a plurality of engaging members are provided for each blind so as to define a plurality of selectable predetermined positions for the sheet material of the blind.

In a further aspect of the invention there is provided an assembly of blind apparatus located along an axis which is substantially perpendicular to the axes along which the free end of the respective blinds can be raised or lowered moved by selective movement of a drive mechanism for each blind apparatus and wherein a location system for each blind includes an engaging member for selective engagement and retention of a formation portion of a drive member of a drive mechanism such that, when the formation portions are retained, the free ends of each of the blinds are retained at a substantially uniform predetermined position.

In one embodiment the blinds in the assembly are respectively positioned such that when the free ends are located at the uniform position, a substantially continuous line is formed by the free ends along the length of the said assembly. This therefore allows the assembly to appear to be a unitary assembly.

Typically the uniform position is selectable by the selective placement of the engagement members and/or provision of a stop with the drive mechanism at the time of installation and may be selected for example, with reference to the external environmental conditions such as the effect of sunlight or street lighting, and/or may be provided so as to provide a desired masking effect with respect to, for example, other office blocks.

In a further aspect of the invention there is provided apparatus which includes at least one portion of sheet material which forms a blind, a drive mechanism for determining and adjusting the extent to which a free end of the blind extends from a roller of the drive mechanism about which the sheet material is wound and wherein the roller is driven to rotate via an escapement mechanism and the engagement system is provided to act upon the escapement mechanism when sheet material is required to be provided at a predetermined position.

In one embodiment the said predetermined position is a position intermediate the fully extended and fully retracted positions of the sheet material.

In a further aspect of the invention there is provided apparatus which includes at least one portion of sheet material which forms a blind, a drive mechanism for determining and adjusting the extent to which a free end of the blind extends from a roller of the drive mechanism and wherein the roller is mounted to be rotated via a sprocket wheel in connection with a pull cord and the apparatus includes an engaging assembly with a plurality of portions which are provided to be located at one of a first or second position and when at least one of said portions is at one of the said first or second portions, the blind is held at a said predetermined position In a yet further aspect of the invention there is provided apparatus which includes at least one portion of sheet material which forms a blind, a drive mechanism for determining and adjusting the extent to which a free end of the blind extends from a roller of the drive mechanism wherein the engaging assembly includes a monitoring means to monitor at least a part turn of a sprocket wheel attached to the roller of the drive mechanism on which the sheet material is wound and thereby determine when the blind has reached a predetermined position and stop the movement of the blind at said position Specific embodiments of the invention are now described with reference to the accompanying drawings wherein;

FIGS. 1*a* and *b* illustrate an elevation and end elevation of a blind apparatus in accordance with one embodiment;

FIG. 2 illustrates a detailed view of a portion of the drive member in the form of a pull cord of a blind apparatus in accordance with one embodiment of the invention;

FIGS. 3*a* and *b* illustrate perspective end views of part of the drive mechanism and engaging member;

FIGS. 4*a-c* illustrate views of the drive mechanism and engaging member of FIGS. 3*a-c* in an engaged position;

FIGS. 5*a-c* illustrate views of the engaging member in accordance with one embodiment of the invention;

FIGS. 6*a* and *b* illustrate a detailed view of the formation portion of the pull cord of FIG. 2 in engagement with an engagement member in accordance with a second embodiment of the invention;

FIGS. 7*a* and *b* illustrate a detailed view of the formation portion of the pull cord of FIG. 2 in engagement with an engagement member in accordance with another embodiment of the invention;

FIGS. 8*a* and *b* illustrate a detailed view of the formation portion of the pull cord of FIG. 2 in engagement with an engagement member in accordance with another embodiment of the invention;

FIG. 9 illustrates a blind apparatus assembly with blinds held at a uniform position in accordance with one embodiment of the invention;

FIGS. 10 and 11 disclose a further embodiment of a mechanism which can be used to provide the required stop of the blind at the intermediate position;

Figure 1A:
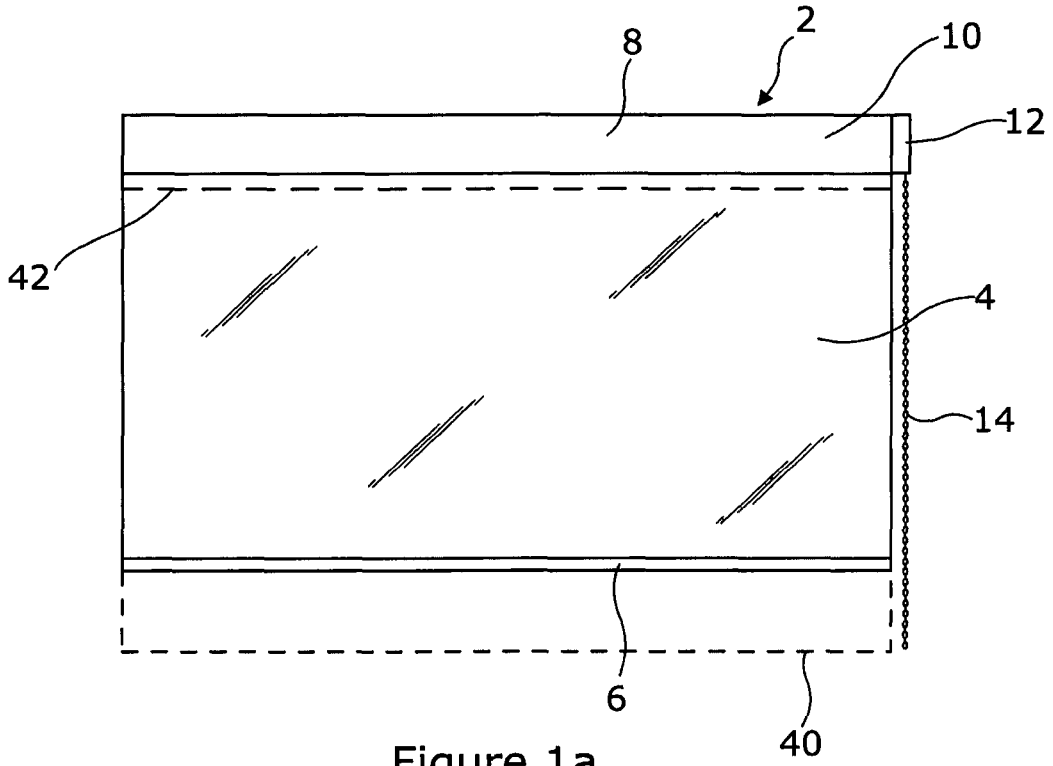
Figure 1B:
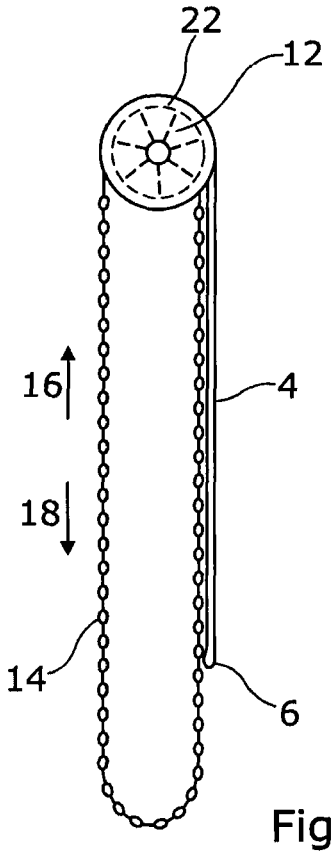

Referring firstly to FIG. 1 there is illustrated a blind 2. The blind includes a portion of sheet material 4 which has a free end 6 and an opposing end 8 which is connected to a roller 10 of a drive mechanism for the blind which moves the sheet material between extended and retracted positions. The drive mechanism 12 also include a sprocket arrangement engaged with the roller and a drive member in the form of a pull cord, also known as a ball chain, 14. The pull cord is typically provided as a loop and movement of the loop causes the rotation of the drive mechanism 12 and in turn rotation of the roller. The rotation of the roller in a first direction 16 causes the free end 6 to be lowered away from the roller and rotation in the opposite direction 18 causes the free end to rise towards the roller as the sheet material 4 is wound round the roller. Typically the free end 6 will stay in the position in which it is placed until the pull cord is moved and hence the drive mechanism is driven.

Figure 2:
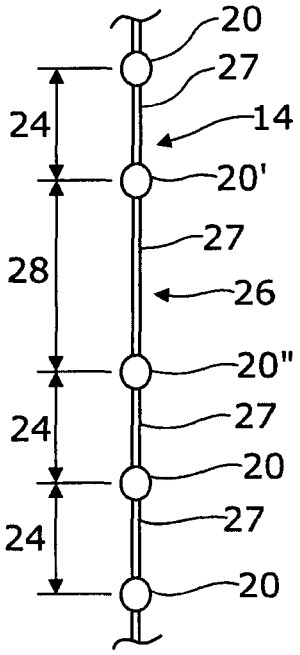

FIG. 2 illustrates a portion of the length of the pull cord 14 which is to act as the engaging portion in accordance with the invention. The pull cord is typically formed with a number of protrusions 20 which are provided to engage in recesses formed around a circular path 22 shown in broken lines in the drive mechanism 12 so that the movement of the pull cord is imparted to the drive mechanism. At any given time, a number, such as 5, of the protrusions will be engaged with the respective recesses so as to ensure good contact between the pull cord and the drive mechanism. The protrusions are typically spaced by apart by a set distance 24. However, in accordance with the invention at at least one formation portion 26, but possibly a number of portions, is provided along the length of the pull cord 26 at which the spacing between the protrusions, indicated by protrusions 20', 20" is at a different distance 28, typically a greater distance, than the spacing 24.

In FIGS. 3*a*-5*c* there is illustrated an assembly in accordance with one embodiment of the invention. In this case there is shown one part of the drive mechanism 12 which is located at one end of the blind apparatus roller mechanism. The drive mechanism includes a roller 30 with the circular path for the protrusions 20 on the drive member pull cord 14. An end support 32 is provided to which the roller 30 is attached and also attached to the same is an engaging member 34 which is located below the end support. The engaging member 34 is provided with buffer or damping springs 36 in this embodiment but these need not always be provided. A fitting 58 is provided which engages with the remainder of the drive roller mechanism.

The engaging member 34 is provided with a passage 38 through which the drive member 14 passes and the drive member is provided as an endless pull cord such that the movement of the same causes movement of the roller 30 and hence movement of the free end 6 of the blind.

In this embodiment the free end of the blind and the drive mechanism can be provided so as to be automatically movable to a default position when the drive member is released and is therefore free to move with respect to the engaging member 34. The default position is typically either that the free end is at a fully extended blind position 40 as shown in broken lines in FIG. 1*a* or a fully retracted position 42 as shown in broken lines in FIG. 1*a*.

Figure 5A:
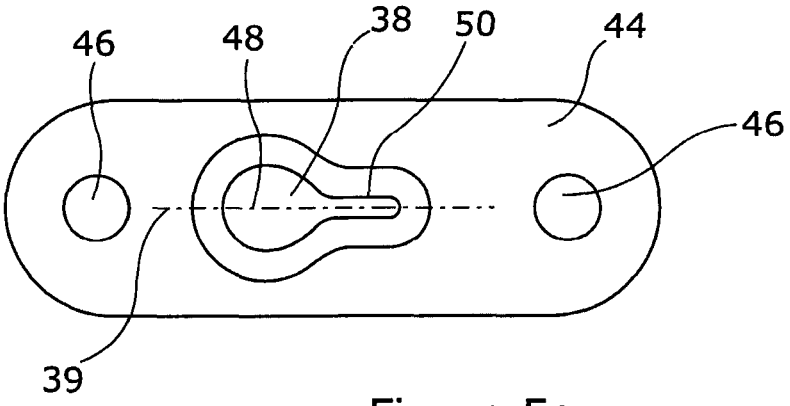
Figure 5B:
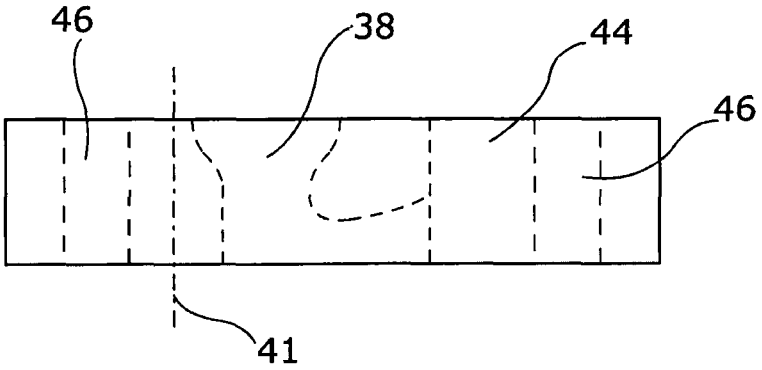
Figure 5C:
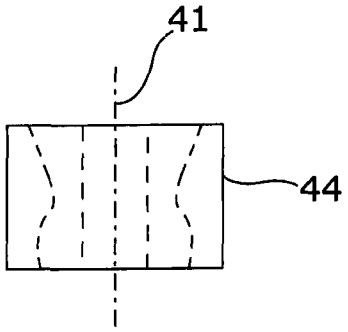

The engaging member 34 is shown in greater detail in FIGS. 5*a*-*c* and comprises a body portion 44 which includes apertures 46 to allow the same to be engaged to the end support 32 and an aperture passage 38 which has a longitudinal axis 39 and includes a first, wider, portion 48 and a second, narrower, portion 50. The wider portion 48 is provided of a size so as to allow the protrusions 20 of the drive member to pass therethrough as the drive member moves along the axis 41 and thereby allow the free movement of the drive member through the engaging member whilst the narrower portion is of a size to only allow the cord 27 to be located thereon and not the protrusions 20. Furthermore the depth of the narrower portion is such that the only the length of cord 27 at the formation portion 26 is sufficiently long so as to be located in the narrower portion as the length of cord between protrusions 20 elsewhere on the drive member is too short to allow the same to be located in the narrower portion 50. This therefore means that when the formation portion 26 is located in the narrower portion 50 of the passage the drive member 14 is effectively locked in position and the same cannot move to the default position and so the free end 6 of the blind is located at a predetermined position.

The relative locations of the engaging member with respect to the drive mechanism can also be used to determine whether the movement of the formation portion into the narrower portion 50 of the engaging member occurs automatically or alternatively the user can be required to move the drive member laterally to the normal movement so that the formation portion is engaged with the narrower portion 50.

Figure 3A:
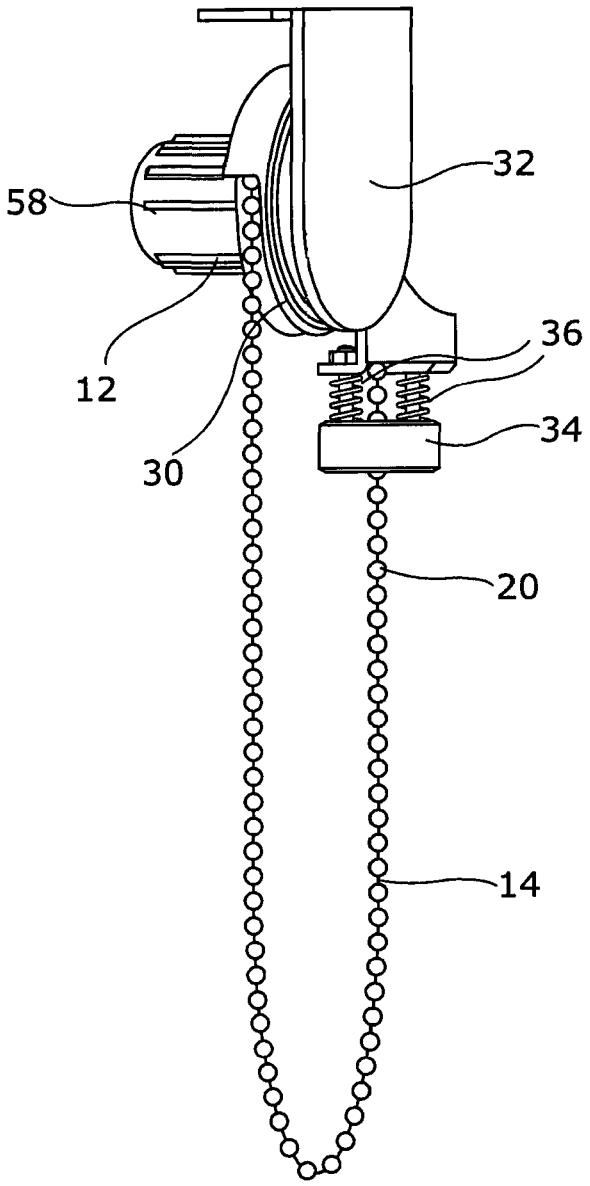
Figure 3B:
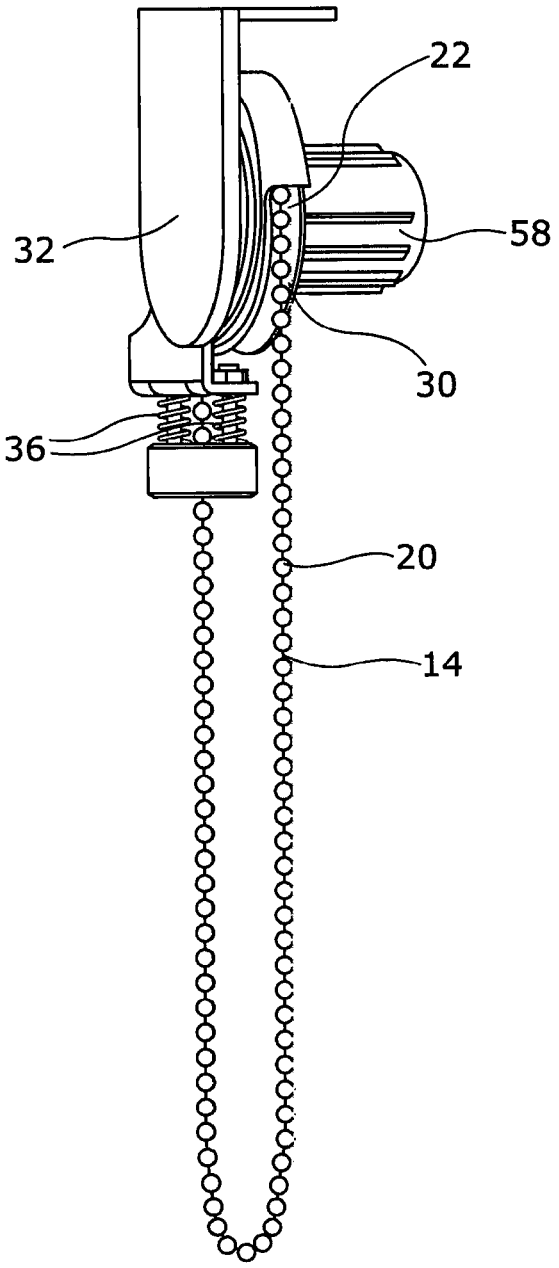
Figure 4A:
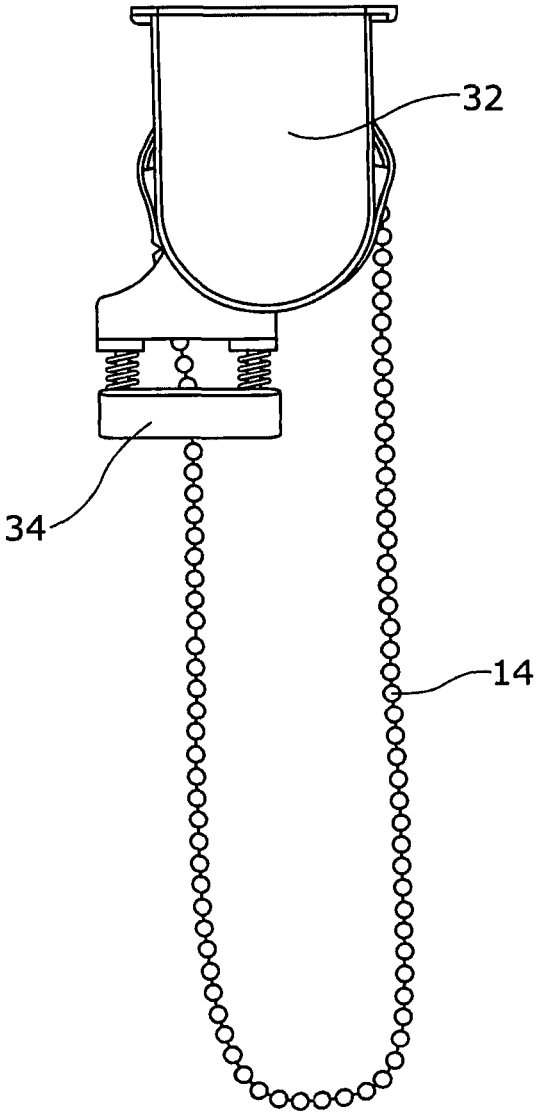
Figure 4B:
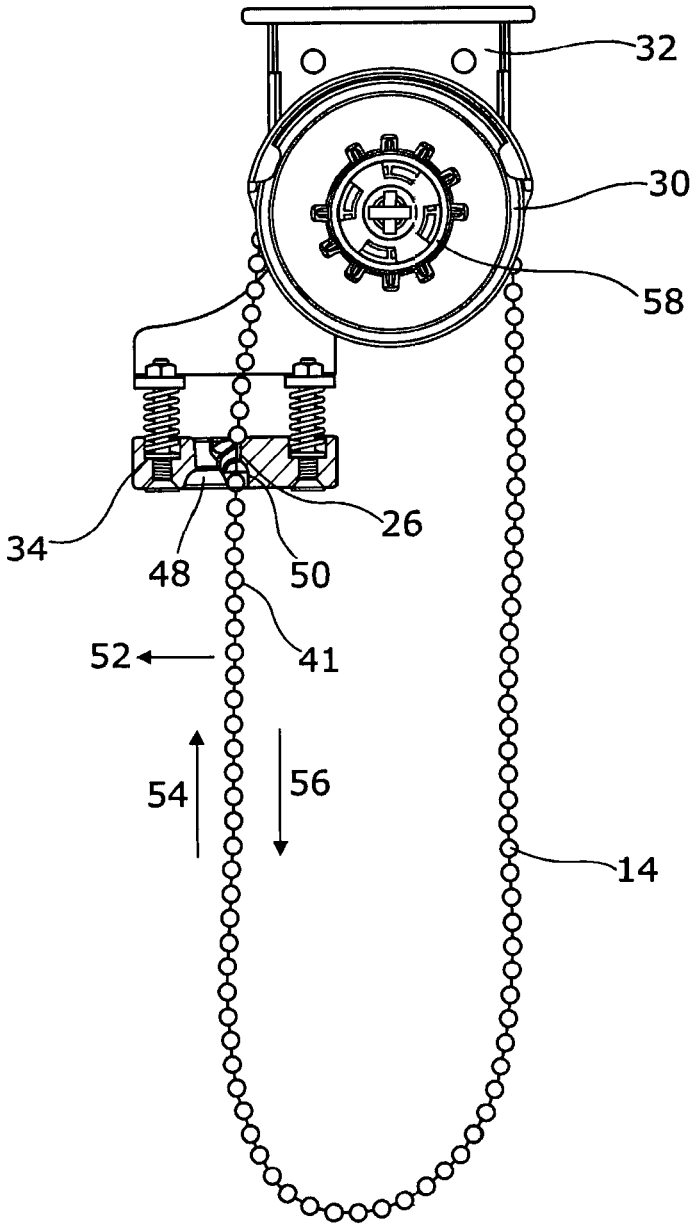
Figure 4C:
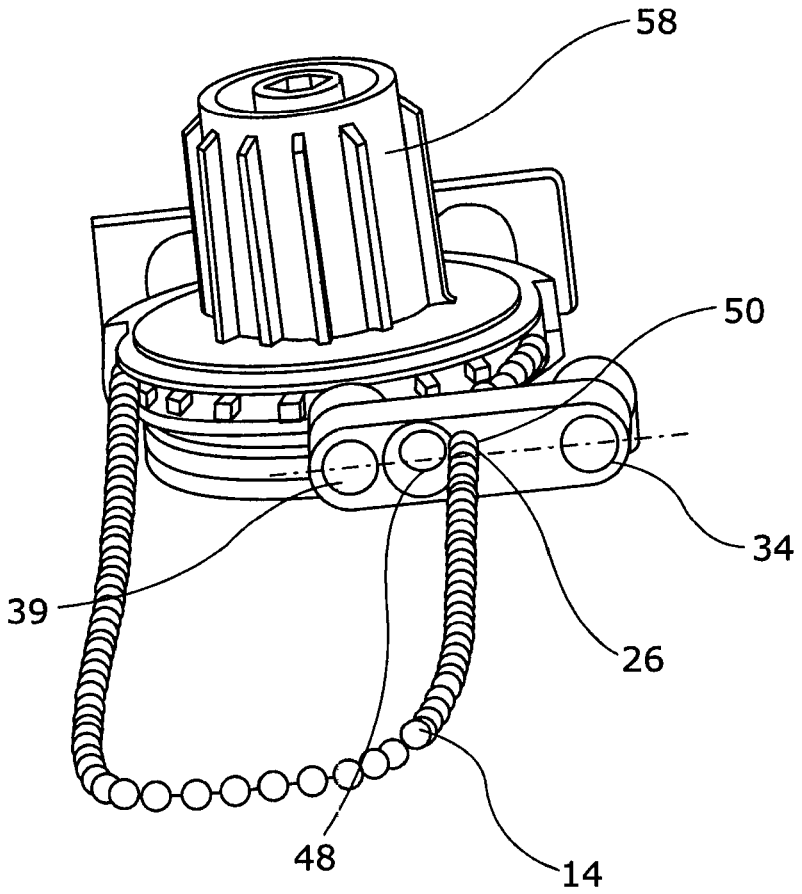

FIGS. 4*a*-*c* illustrate the components of FIGS. 3*a* and *b* and 5*a*-*c*, with the formation portion 26 of the drive member 14 in an engaged position with the narrower portion 50 of the passage 38 of the engaging member 34. It will be seen that the portion of the chain is offset in the region of 5-15 degrees from the vertical as it passes through the wider portion 48 of the passage 38 of the engaging member such that when the formation portion 26 reaches the engaging portion the length of cord 27 of the formation portion moves into and engages with the narrower portion 50 of the engaging member 34. The formation portion 26 will remain in this position until the user moves the drive member 14 in the direction of arrow 52 to move the same into the wider portion 48 and the drive member 14 can then be moved in the directions 54, 56 as desired either by the user or under the influence of the drive mechanism.

In the embodiments illustrated above and those described which follow, an escapement mechanism 170 can be provided within and in connection with the roller 172 of the drive mechanism, part of which is shown in cross section. The roller 172 is connected to be rotated by a drive wheel 174 of the escapement mechanism which is located along the axis 176 which is also the longitudinal axis of the roller 172 in which there is provided a shaft 178 which is connected to the conventional spring mechanisms (not shown) located along the interior of the roller and which provides the controlled movement of the blind and biases the blind to a default position which may, for example, be a fully extended position.

The drive wheel is connected to a cog wheel 180 which is toothed and which interacts with an escapement lever 182 which clicks round on the wheel 180 as it rotates. The escapement lever 182 is connected to a flywheel 184 via a transfer lever 186 which has a drive shaft 190 on which is mounted a hair spring 188 which can act as a buffer means to take into account movement of the drive mechanism after the formation portion of the pull cord 14 has been located at a stop position. The movement of the pull cord and hence formation portion on the same to the stop location for the predetermined intermediate blind position is detected by the locking lever which is normally biased by the spring 194 and, when detected, the locking lever is moved as indicated by arrow 196 to a position to prevent the continued rotation of the drive wheel 174, and hence roller 172, and thereby stop the blind at the predetermined intermediate location.

Figure 11:
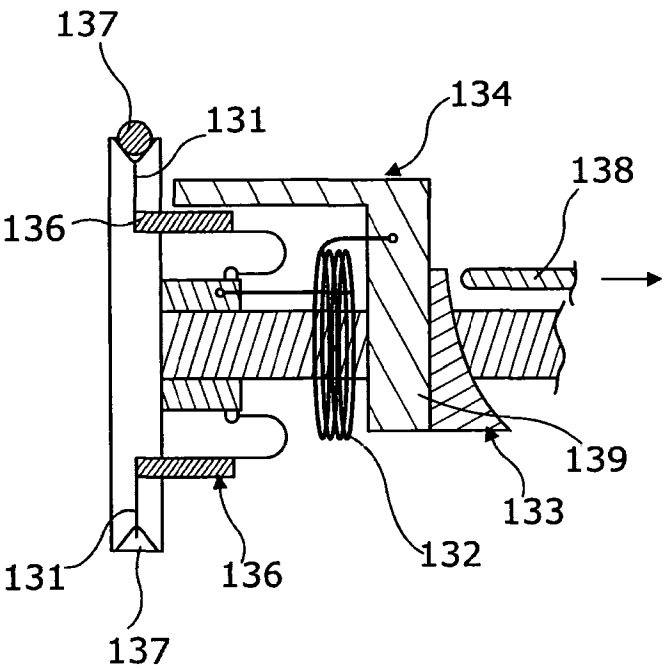
Figure 10:
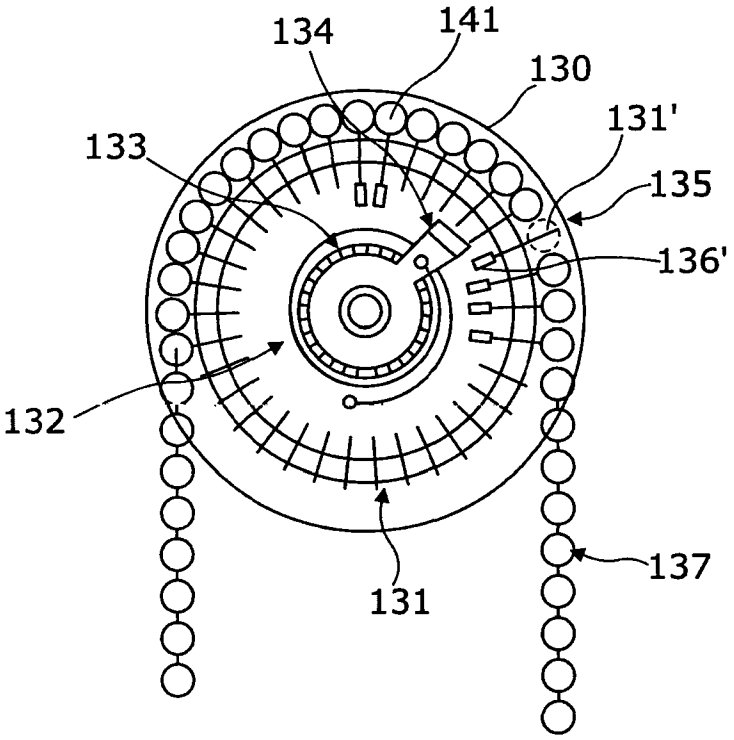

Referring now to FIGS. 10 and 11, there is provided an alternative embodiment whereby the intermediate stop position of the blind can be achieved using the drive formation 135 of the pull cord. In this case there is shown a drive mechanism sprocket 130 which has an array of sensor pins, 131 located along an annular path on the sprocket face and which extend outwardly towards the pull cord 137 which extends around the sprocket as shown. Each pin 131 is connected to a blade 136 and is depressed by a ball 141 of the chain, 137, as the chain passes around the sprocket. However when the drive formation 135, arrives at, and passes around the sprocket by pulling on the pull cord 137, it passes around the sprocket and does not depress one of the pins 131'. This "un-depressed" pin causes the blade 136' attached to it to catch the otherwise static catching arm 134 which then rotates with the sprocket wheel and a spiral cam 133 which is attached and so causes a locking lever 138 of an escapement mechanism to be pressed. When the locking lever 138, is pressed the movement of the escapement mechanism is stopped and so the movement of the blind is stopped at the predetermined intermediate position as required.

A return spring 132 is attached to the catching arm 134 and this performs two functions, one of which is to apply a decelerating force to the blind whilst it is brought to a stop, and secondly to return the arm to the ready position when movement of the blind is again required and achieved by pulling on the pull cord 137. A standard sequential mechanism 139 is located within the spiral cam 3 housing. This locks and releases sequentially, so every other time the mechanism catches, it will result in the blind coming to a stop. This allows the blind to be released from the locked position by pulling the chain down again, and releasing a second time.

An advanced version would include a gas or fluid damper in addition to the return spring 132, to bring the blind to a stop.

Figure 12:
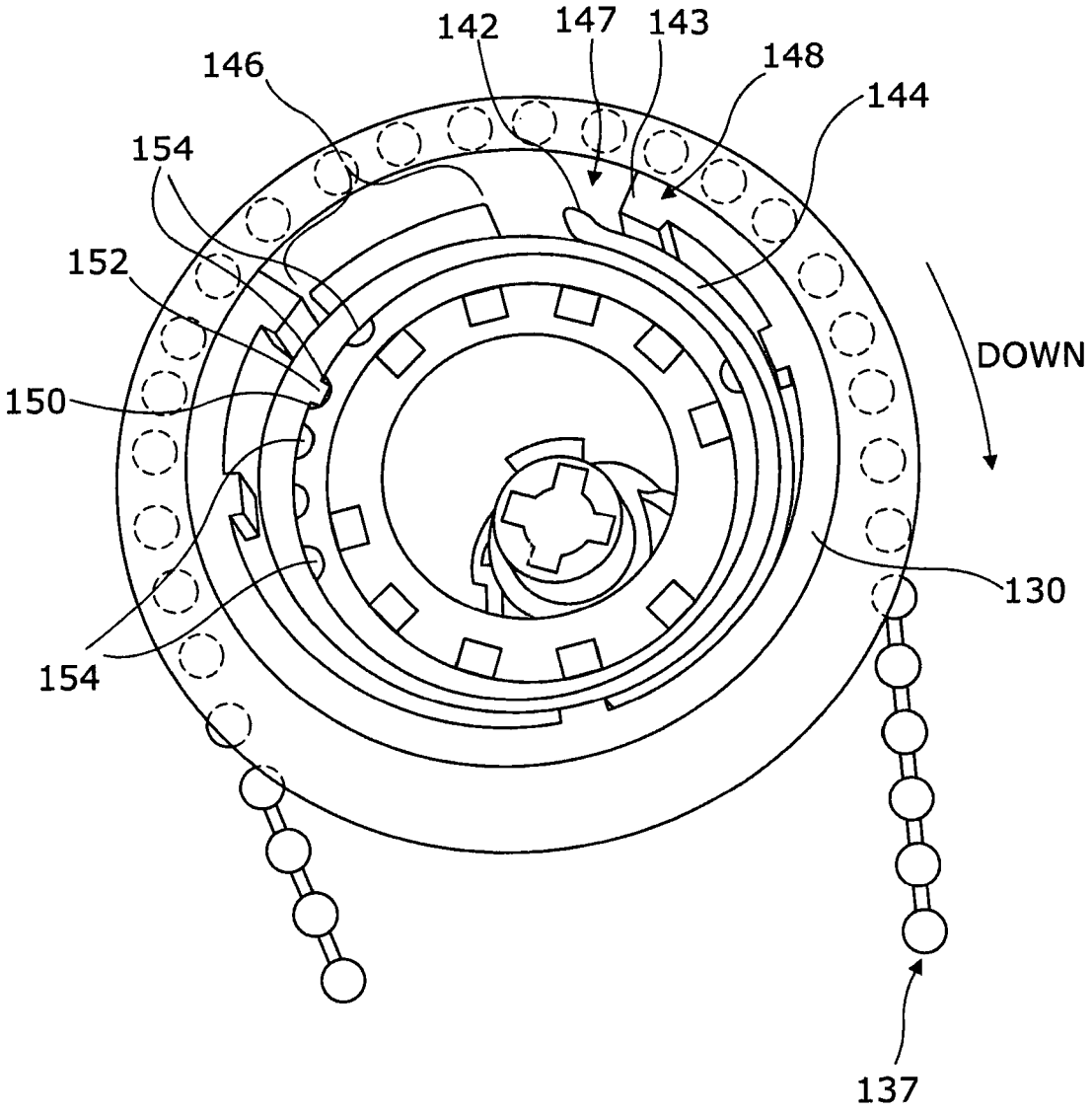
FIG. 12 illustrates an embodiment of a buffer system to absorb movement of the drive mechanism once the predetermined position has been reached.

Turning now to FIG. 12 there is shown a photograph of the sprocket arrangement in one embodiment in which the pull cord 137 is shown where it passes around the sprocket 130.

When the blind is running down, the sprocket 130 and blind housing 148 run together, in the direction shown 'Down'. When the pull cord catches on the stopping block, the rotation of the sprocket 130 stops instantly but the blind tries to continue running down and the momentum of which is directly connected to the blind housing 148. This continues to rotate, but pushing against a spring 144 with first and second ends 142, 152 and the spring is coiled and located around the inside of the housing 148.

One end of the spring 142 locates into the sprocket 130 at location 147, and the other end 152 into the housing 148 at 150

The portion of free space 146 is the maximum distance the blind can continue to run before either coming to a stop against the spring force, or stopping against the sprocket shoulder at 147.

This spring force can be adjusted during manufacture by selectively placing the end 152 of the spring in one of a series of spaced locating apertures 154 in the blind housing 148. The spring force must be sufficient to return the sprocket shoulder 147 and blind housing 148 tight together at 143 when the blind is at rest, in order that an accurate final resting place is always achieved in relation to the pull cord 137. This arrangement would avoid the need to use the buffer springs 36 shown in FIGS. 3*a*-4*c*.

Figure 13:
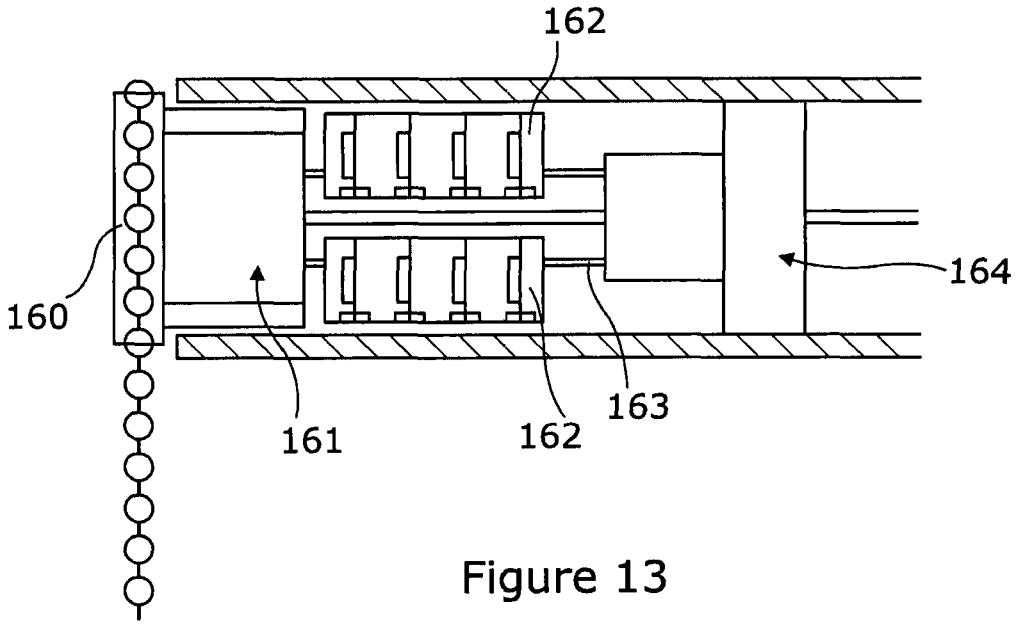
FIGS. 13 and 14 illustrate a further embodiment of the invention which allows the predetermined intermediate position of the blind to be achieved.
Figure 14:
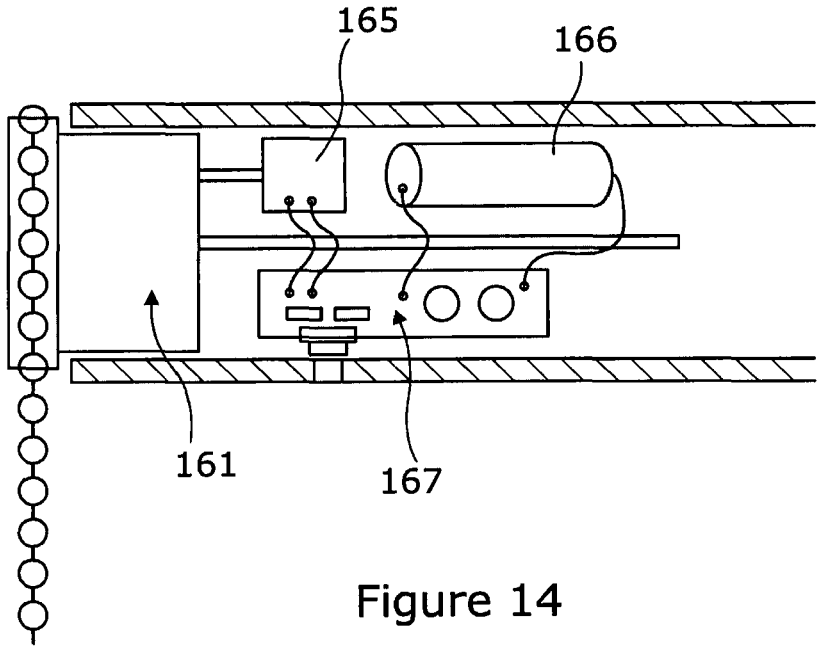
Figure 15:
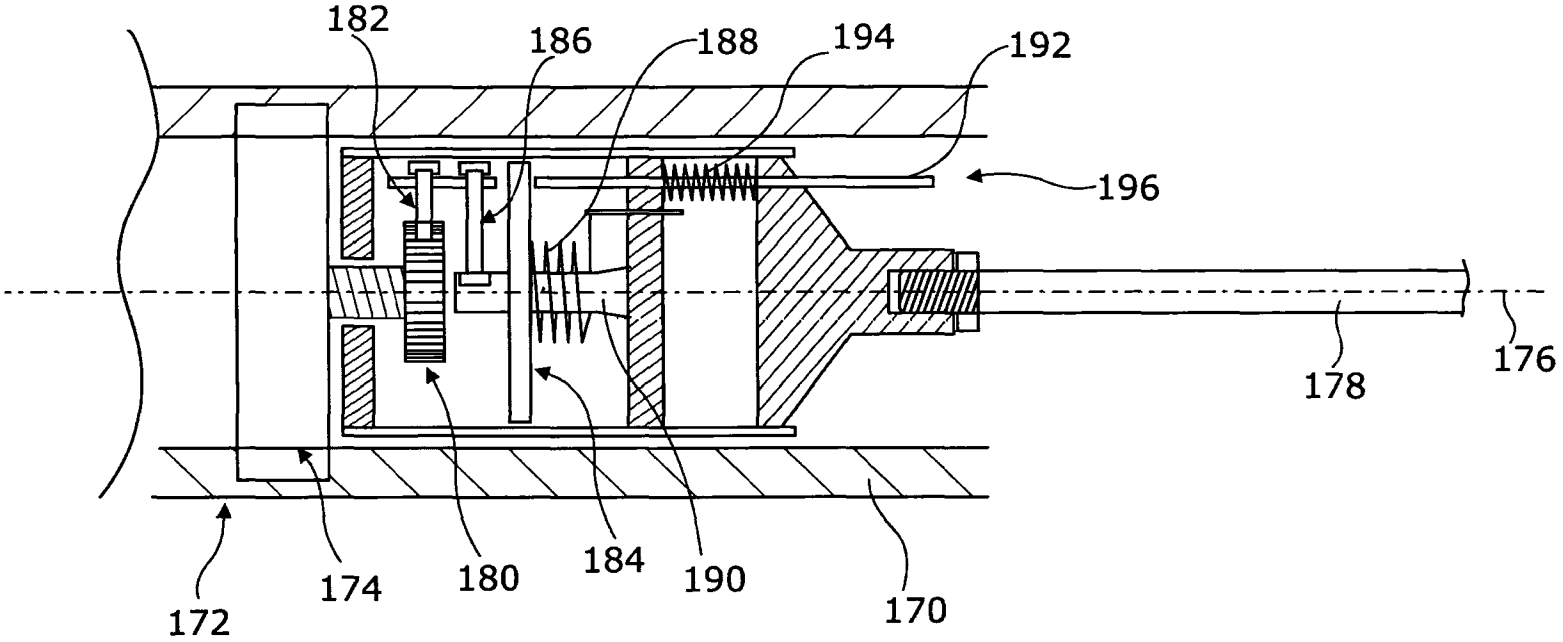
FIG. 15 illustrates an escapement mechanism for use in accordance with one embodiment of the invention.

Referring now to FIGS. 13 and 14 there is illustrated a further embodiment of the invention. In this embodiment a counter system is utilised. In which the at least one predetermined stop position is detected and implemented as a result of counting the number of turns, or degrees of turns of the drive mechanism sprocket 160.

The sprocket 160 is connected to a planetary gearbox 161 to increase the speed of turn (and reduce the torque) required to achieve the rotational force under the influence of the pull cord 137. Two outputs from this gearbox are fed into two mechanical turn counters 162 which may be similar in style to an odometer and these are re-settable via a hole in the blind tube. The counters count the number of turns to a high degree of accuracy and on reaching the zero point which is equivalent to the predetermined intermediate position at which a stop is required, trigger a brake 163 via an escapement mechanism 164 described above.

FIG. 14 disclose a similar system to that shown in FIG. 14 but in this embodiment the counting is done via a rotary encoder & electromagnetic brake 165 which would be able to maintain and govern the blind descent speed, removing the need for an escapement mechanism. A battery 166 provides power for the control circuit 167 and in one embodiment is charged by the brake 165 when the blind is ascending or descending.

In the embodiment of either FIG. 13 or 14 alternative stop positions can be programmed on site thereby providing variation to suit different environmental conditions such as for example to provide a summer setting and a winter setting of the predetermined position(s) without the need for a mechanical change to the chain.

Figure 6B:
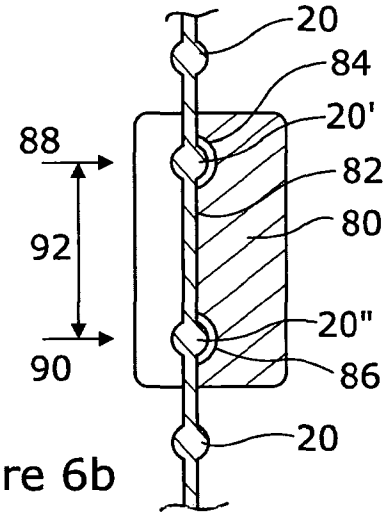
Figure 6A:
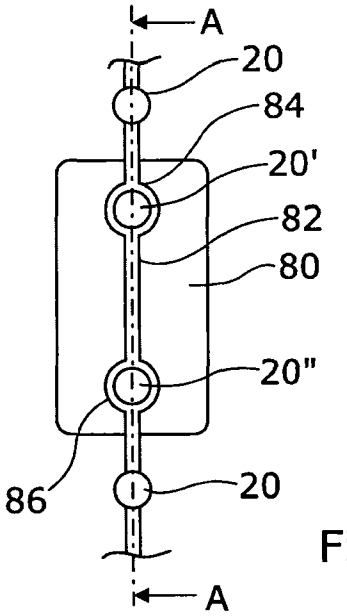

In another embodiment shown in FIGS. 6*a* and *b* the difference in spacing at formation portion 26 allows the protrusions 20',20" of the drive member to be received within an engagement member 80 as shown in FIGS. 6*a* and *b*. The engagement member is provided at a fixed location on a surface such as a wall and at the required location such that when the formation portion 26 of the pull cord is engaged therewith, the free end 6 of the blind will be guaranteed to be at a predetermined height as the height of the engagement member is known, as is the location of the formation portion 26 of the drive member pull cord 14 with respect to the position of the free end 6 of the sheet material as that can be fixed at the time of forming the blind and remains the same during use of the blind.

In order to engage the formation portion 26 and the engagement member 80, the portion 26 of the pull cord is brought into line with the track 82 formed in the engagement member. When in line, the track indent 84 is in line with the protrusion 20' of the pull cord and the track indent 86 is in line with the next protrusion 20". When in position, the protrusions 20', 20" can be pushed into the respective indents as indicated by arrows 88, 90. The indents may be formed so as to exert a grip on the protrusions so as to retain the protrusions in position until a release force is applied thereto.

It will be appreciated that because there is no indent provided in the space between the indents 84, 86 on the engagement member then no other part of the pull cord can be engaged with the engagement member 80 by two protrusions as the spacing 24 between the protrusions 20 of the remainder of the pullcord is less than the spacing 92 between the indents 84,86.

Figure 7A:
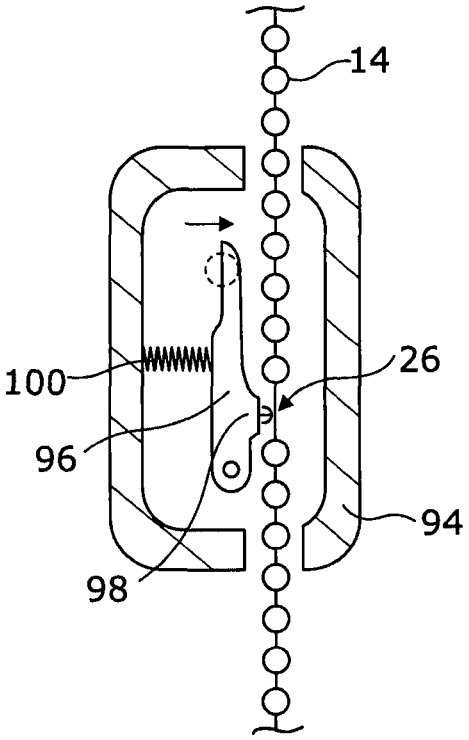
Figure 7B:
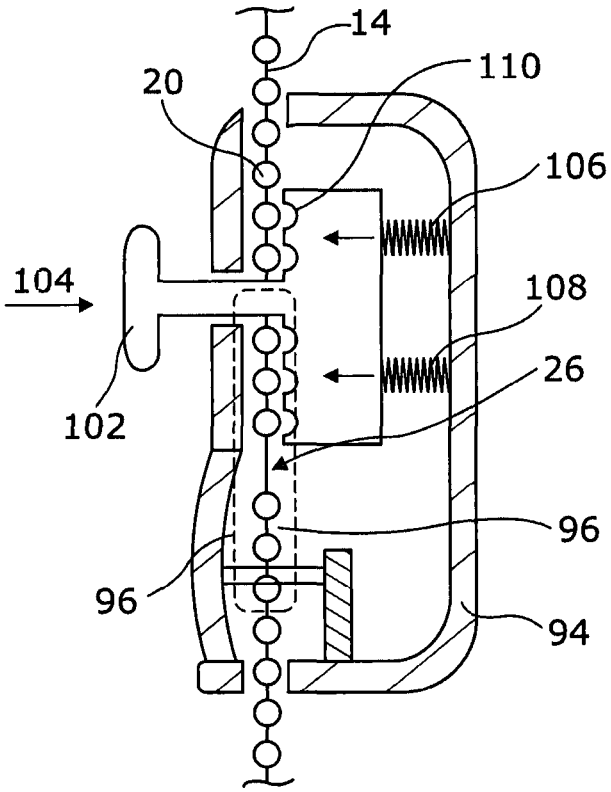

FIGS. 7*a* and *b* illustrate a further embodiment of the invention and in this case the drive member 14 again has a formation portion in the same manner as that described with reference to FIGS. 6*a-b*. In this case the engagement member 94 is provided, again to be fixed at a position on the wall or frame, but is provided with a trigger portion 96 which has lug 98 formed so as to engage in the gap of the portion 26 of the drive member 14 and hence retain the same in that position. The trigger is biased towards the retaining position by at least one spring 100 and is pivotably movable. There is also provide a reset button 102 which can be pressed in the direction of arrow 104 to act against biasing springs 106, 108 and hence release the contact between the indents 110 and protrusions 20 in the drive member 14 and return the trigger 96 to a position in which the drive member 14 can again be moved through the engagement member and the trigger latch cannot engage with the same until the formation portion 26 passes through again.

Figure 8A:
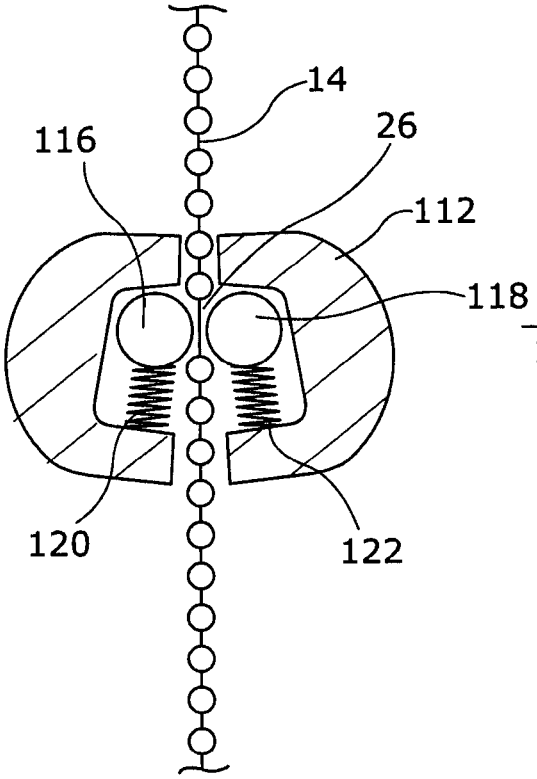
Figure 8B:
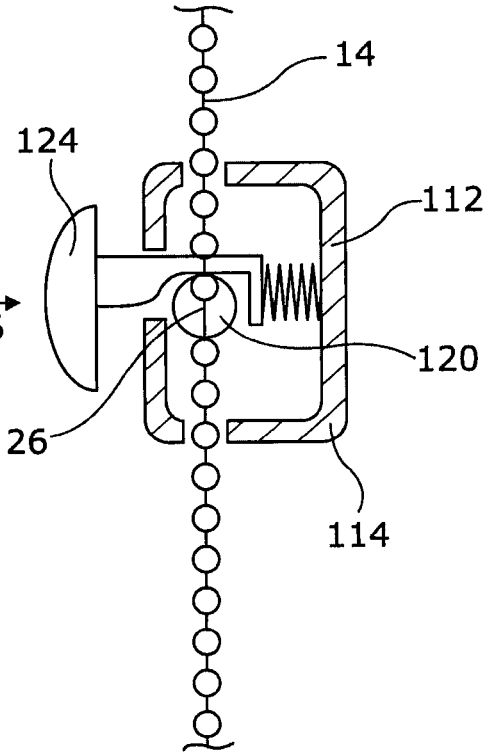

FIGS. 8*a-b* illustrate a further embodiment of an engagement member 112 which is again for use for a drive member pull cord 14 with a formation portion 26 as previously described. In this case the engagement member includes a body 114 and in this case there are provided first and second biased catches 116,118 which are biased towards an engaging position with the formation portion 26 as shown. The biasing is achieved via springs 120,122. It will be appreciated that the catches 116,118 are dimensioned so that they will only engage with the gap of the formation portion 26 and not with the smaller gap between the other protrusions 20. A reset button 124 can be pressed inwardly as indicated by arrow 126 to release the catches and hence release the drive member 14 and allow the same to be moved through the engagement member freely.

Figure 9:
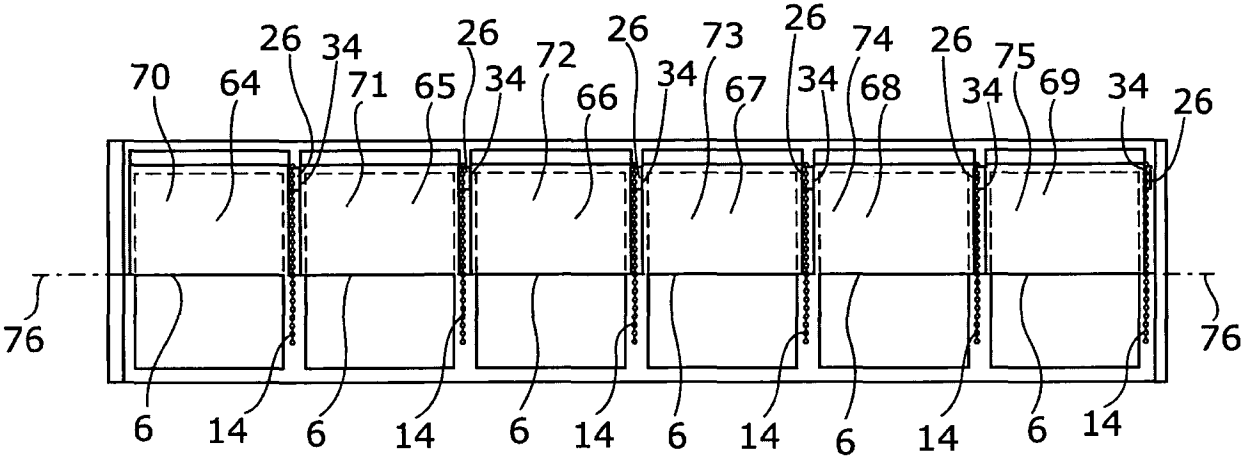

FIG. 9 illustrates the manner in which a number of blind apparatus 64-69 are provided side by side with respect to windows 70-75. Engagement members 34 are mounted at the roller mechanism in accordance with the embodiment of FIGS. 3*a*-5*c* at each window as indicated. As shown, the drive member pull cords 14 for the respective blind apparatus are each located such that the portion 26 thereon is located with the engagement member 30. This therefore means that the free end 6 of each blind is positioned at the same height and therefore provides a uniform free end of the blinds in combination along the uniform line 76 and with respect to the windows.

The invention claimed is:

1. An apparatus which includes at least one portion of sheet material which forms a blind, a drive mechanism for determining and adjusting the extent to which a free end of the blind extends downwardly from a roller of the drive mechanism, the apparatus further including an engagement system which, when engaged, acts to prevent rotation of the drive mechanism and hence retain the blind at least in one predetermined position intermediate a fully retracted position and a fully extended position of the blind, said engagement system including an engaging member and at least one formation portion, said at least one formation portion provided on an elongate drive member of the drive mechanism and engagable with the engaging member to define the said predetermined position, wherein said elongate drive member includes a series of protruding portions on a cord at substantially equally spaced intervals therealong and said at least one formation portion is formed as a length of said cord with no protrusions and the said length is greater than a spacing between adjacent ones of the substantially equally spaced protruding portions, wherein the spacing between the adjacent substantially equally spaced protruding portions prevents engagement between the elongate drive member and the engaging member.

2. The apparatus according to claim 1 wherein the predetermined position is selected by selectively locating the engaging member at a fixed position and a location of the formation portion on the elongate drive member of the drive mechanism.

3. The apparatus according to claim 2 wherein the predetermined position is selected by locating the engaging member at a fixed location on a structure to which the apparatus is fitted.

4. The apparatus according to claim 1 wherein ends of the length of said formation portion are defined by respective protruding portions located on said cord and which are spaced apart by a distance which is greater than the spacing between one of the protruding portions defining the formation portion and a respective one of the protruding portions located on an opposing side from the said formation portion.

5. The apparatus according to claim 1 wherein the drive mechanism is biased towards a default position.

6. The apparatus according to claim 5 wherein the blind moves to the default position unless the movement is prevented by engagement of the formation portion with the engaging member.

7. The apparatus according to claim 6 wherein the engagement occurs automatically as the elongate drive member moves past the engaging member when the formation portion reaches the engaging member.

8. The apparatus according to claim 6 wherein the engagement occurs when the user selectively positions the elongate drive member with respect to the engaging member so as to cause engagement of the formation portion with the engaging member.

9. The apparatus according to claim 1 wherein the engaging member includes a component which is biased towards a position to lock the formation portion with the engaging member.

10. The apparatus according to claim 1 wherein the elongate drive member passes through an aperture formed in the engaging member, said aperture having a longitudinal axis, and said elongate drive member moves through the aperture along an axis which is substantially perpendicular to the longitudinal axis of said aperture.

11. The apparatus according to claim 10 wherein the aperture has first and second portions located along the longitudinal axis, said first portion of a dimension to allow the protruding portions of the elongate drive member to pass therethrough and the second portion of a size to prevent the movement of the elongate drive member protruding portions therethrough.

12. The apparatus according to claim 11 wherein the elongate drive member is selectively movable along said longitudinal axis of the aperture to cause the elongate drive member to be moved between free and engaged positions with the engaging member.

13. The apparatus according to claim 12 wherein the engaging member and elongate drive member are respectively positioned or provided so as to bias the elongate drive member towards the second portion of the aperture so that the formation portion on the elongate drive member locates therein when located at the engaging member.

14. The apparatus according to claim 1 wherein a plurality of blind apparatus are connected such that free ends of the plurality of blind apparatus are movable by operation of a common drive mechanism and engaging member.

15. The apparatus according to claim 1 wherein a plurality of blinds are provided along a length and an engaging member and a drive mechanism with a drive member is provided for each of the blinds, said drive members each provided with a formation portion at a same relative location such that when the formation portion of the drive member for each respective blind is retained by the respective engaging member, a free end of each of the blinds is provided at substantially a same position.

16. An assembly of a plurality of blind apparatus located along an axis which is substantially perpendicular to axes along which a free ends of respective blinds can be raised or lowered when moved by selective movement of a drive mechanism for each blind apparatus and wherein an engagement system for each blind includes an engaging member for selective engagement and retention of a formation portion of an elongate drive member of each drive mechanism such that, when the formation portions are retained, the free ends of each of the blinds are retained at a substantially uniform predetermined position, each said engagement system formation portion engagable with the engaging member to define the said predetermined position, wherein elongate drive member includes a series of protruding portions on a cord at substantially equally spaced intervals therealong and each formation portion is formed as a length of said cord with no protrusions wherein said length is greater than a spacing between adjacent ones of the substantially equally spaced protruding portions, wherein the spacing between the adjacent substantially equally spaced protruding portions prevents engagement between each elongate drive member and each respective engaging member.

* * * * *